US008510916B2

(12) United States Patent
Kinvi

(10) Patent No.: US 8,510,916 B2
(45) Date of Patent: Aug. 20, 2013

(54) MINI FLAG CLIP

(76) Inventor: Mensan Teko Kinvi, New York, NY (US)

( * ) Notice: Subject to any disclaimer, the term of this patent is extended or adjusted under 35 U.S.C. 154(b) by 414 days.

(21) Appl. No.: 12/462,479

(22) Filed: Aug. 4, 2009

(65) Prior Publication Data

US 2010/0058972 A1 Mar. 11, 2010

Related U.S. Application Data

(60) Provisional application No. 61/191,256, filed on Sep. 8, 2008.

(51) Int. Cl.
*G09F 17/00* (2006.01)

(52) U.S. Cl.
USPC ..... 24/3.12; 24/457; 248/539

(58) Field of Classification Search
USPC ..... 24/5, 6, 3.7, 326, 3.12, 3.1, 457, 24/336, 910, DIG. 28, DIG. 8, DIG. 29, 541, 24/546, 10 R, 11 R, 11 P, 11 C, 11 CT, 3.9, 24/3.11, 298, 300, 570; 116/209, 173; 2/10, 2/209.13, 195.1, 209.12, 195.4, 209.14, 68; 224/269, 249, 666; 248/511, 534, 535, 539
See application file for complete search history.

(56) References Cited

U.S. PATENT DOCUMENTS 550,274 A * 11/1895 Johnson ..... 24/53
687,892 A * 12/1901 Luth ..... 24/6
1,597,266 A * 8/1926 Dearman ..... 248/514
1,618,384 A * 2/1927 Morris ..... 24/570
1,648,408 A * 11/1927 Kumagai ..... 24/67.9
2,013,271 A * 9/1935 Greenhoe ..... 248/539
3,722,841 A * 3/1973 Ciolfi ..... 248/539
3,825,214 A * 7/1974 Ciolfi ..... 248/539
4,599,965 A * 7/1986 Johnson ..... 116/209
4,876,771 A * 10/1989 Givati ..... 24/298
5,066,154 A * 11/1991 Renaud ..... 401/131
5,463,974 A * 11/1995 Seeder ..... 116/173
5,829,103 A * 11/1998 Allen ..... 24/11 R
5,867,874 A * 2/1999 Simpson ..... 24/336
5,881,391 A * 3/1999 Mullaney ..... 2/209.13
6,481,060 B1 * 11/2002 Tsai ..... 24/3.12
6,637,074 B1 * 10/2003 Morris ..... 24/3.12
6,874,167 B1 * 4/2005 Leszczynski ..... 2/209.13
6,964,403 B2 * 11/2005 Fox ..... 248/537
7,229,172 B2 * 6/2007 Presswood et al. ..... 351/155
7,234,411 B1 * 6/2007 Butler ..... 116/173
2002/0069488 A1 * 6/2002 Morris ..... 24/3.12
2002/0184738 A1 * 12/2002 Tsai ..... 24/3.12
2003/0183739 A1 * 10/2003 Fox ..... 248/537
2005/0223525 A1 * 10/2005 Wartian et al. ..... 24/3.12
2005/0268378 A1 * 12/2005 Butler ..... 2/209.13
2006/0021117 A1 * 2/2006 Madonia ..... 2/422
2007/0101922 A1 * 5/2007 Kengerski ..... 116/28 R
2008/0295295 A1 * 12/2008 Rogers ..... 24/3.12

* cited by examiner

*Primary Examiner* — Robert J Sandy
*Assistant Examiner* — Abigail E Morrell

(57) ABSTRACT

A device to connect a fabric headgear to a mini stick flag or to a mini stick banner. Functioning as a clip and a retainer as well, it applies a strong enough hold on any spot at the bottom circular thin edge of a fabric headgear and provides a cavity for a common mini stick flag or for a mini stick banner to stand straight in a nearly vertical position to let the flag or banner float above the head of the bearer.

4 Claims, 6 Drawing Sheets

MINI FLAG CLIP

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

THE NAMES OF THE PARTIES TO A JOINT RESEARCH AGREEMENT

Not applicable

BACKGROUND OF THE INVENTION

1. Field of the Invention

The present invention relates to devices and methods concerning flags' and banners' bearing on headgears.

2. Description of the Related Art

Social life anywhere is punctuated by frequent special moments like parades, rallies, games, and concerts. During these special moments, flags and banners are the best useful objects people display to show off sympathy or fun. But flag holding during parades and other manifestations is not an easy job. Most of the flags or banners are chosen at a size that only strong arms can hold them for a bit long time. Weak arms that choose small size flags and banners are not at comfort either. Holding and shaking even a mini flag or mini banner doesn't give you room to sip freely your coffee to rocket your enthusiasm or to lick an ice-cream to cool off during these exiting moments. So what could be a solution? What can make it easy to happy people in crowd or enthusiastic groups to display floating flags and banners in unison? The Mini Flag Clip is invented as a solution.

Previous inventions addressed the subject of attaching or strapping useful objects together for more convenience in the use. In this art, U.S. Pat. No. 1,648,408 attributed to Buntaro Kumagai in 11-1927 claims a paper fastener and hunger comprising a flat trifurcated body, three legs lying in the same planes to fasten a paper and having a prong on the center leg to secure fastened paper to a wall or like support.

U.S. Pat. No. 3,722,841 issued to Ciolfi Quentin P. in 03-1973 claims a holder, which is a planar elongated body to be secured to the axle of a bicycle or of kind vehicle by nuts and having a pair of socket to bear a flagstaff in a vertical position. Another U.S. Pat. No. 3,825,214 granted to Ciolfi in 07-1974 improves his previous holder in a simple feature and easier method to bear flag staff on a bicycle or of kind vehicle.

U.S. Pat. No. 4,876,771 granted to Givati Izhak in 10-1989 claims a plastic clip particularly useful as a clothes pin for hanging articles of clothing on a clothes line. The clip comprises a strip of an elastic plastic material formed with one or two openings therethrough for receiving the clothes line, and with a slot extending from each opening to an edge to define two or three jaws for gripping the article to be hung from the clothes line. The sides of each slot are formed with a zigzag configuration to define teeth on the edges of the jaws for gripping the article of clothing between them.

U.S. Pat. No. 5,066,154 issued to Renaud, J. mautice in 11-1991 is a multipurpose clip and comprises a generally flat member which is formed of a slight curvature enabling it to rest against the surface of the security hat. A hook is formed from the member enabling to introduce and hold a pencil or an object of the same type. The flat member comprises a tongue intended to be introduced in the cavity by snapping thereby preventing the exit of the tongue once the latter is in position in the cavity.

U.S. Pat. No. 6,874,167 granted to Lesczynski, Christopher J. in 04-2005 claims a hat mountable flag for removably positioning on a hat includes a rod that is elongated and has a first end and a second end. A flag is mounted on the rod. A fastener is attached to the second end of the rod for removably attaching the rod to the hat.

U.S. Pat. No. 6,964,403 issued to Fox, Steven Alfred in 11-2005 is a one piece molded miniature flag holder used to display the smallest sized flags, banners or pennants on computers, cash registers, refrigerators, filing cabinets or walls and partitions for decorative purposes. The flag holder displays the flags, banners or pennants at a nearly vertical position, and can be attached to multiple surfaces with double-sided adhesive mounting tape, magnet strip tape, and/or Velcro™ hook and loop fastening system.

U.S. Pat. No. 7,234,411 to Butler Steven R. in 06-2007. A helmet flag for providing added visibility and therefore safety to a rider of virtually any form of transportation that exposes a rider to view. The flag is preferably mounted to the rear of a helmet and is substantially removable. The flexible, interchangeable flag rod is partially comprised of a spring to further insure against breakage. Flags are interchangeable with respect to size, colors, and designs.

U.S. patent application Ser. No. 2006/0021117 by Madonia Stephen J. in 02-2006 describes a motorcycle helmet flag assembly which is a decorative assembly for use with any type of motorcycle helmet that allows the user to decorate the helmet with a variety of different flags. The assembly includes a receptacle member that can be permanently attached to a rear portion of the helmet and engagement member with an attached flag that is designed to engage the receptacle in a detachable manner, resulting in the visible display of the flag near the rear of the helmet while the user is riding his or her motorcycle.

U.S. Pat. No. 6,481,060 granted to Tsai Yu-Chi in 12-2002 is a multi-purpose cap clip, comprising a clip unit, a holding device, and an accessory object. The clip unit has a fixing plate and two clasping plates to two sides of the fixing plate, with the fixing plate and the two clasping plates clasping a brim of a cap. The accessory object has a holding element which fits on the holding device and is held thereby. After assembly of the structural parts, the clip unit fastens the accessory object on the brim of the cap.

U.S. patent application Ser. No. 2008/0295295 A1 by Brad A. Rogers and published in 12-2008 describes a cap-mountable flag assembly that selectively displays a message. The flag assembly is mountable to the brim of a baseball type cap, and comprises a flag element, a rod or pole element, and a clip element. The flag element comprises rod-receiving, clipping arms and a message-bearing structure. The arms comprise groove-engaging protrusions.

While the above patents are efficacious to achieve their goal, there is a necessity for researches to advance the art and the methods.

Close examination shows that none of the devices cited above is designed to serve as a connector of a mini stick flag or a mini stick banner to the bottom circular thin edge of the following different fabric headgears: a baseball cap, or a visor cap, or a do-rag or a headband or an ear band or a bandanna. None of their techniques is intended to fix a clip to any spot at the bottom circular thin edge of a fabric headwear to hold a mini stick flag or a mini stick banner or the like ornament straight up in a nearly vertical position on the head of the bearer. Their methods are obviously different, and some of them that are specifically related to flag bearing on headgears are limited to one headwear type and are often more complex in structure compared to the invention herein.

BRIEF SUMMARY OF THE INVENTION

The Mini Flag Clip, designed with a very simple feature, is a different technique and an easier method to hold straight up mini stick flag or mini stick banner or the like ornament to the bottom circular thin edge of fabric headgears.

This one-piece device intends to be a connector between fabric headgears and already existing and popular mini stick flags or mini stick banners. The Mini Flag Clip permits to take the lovely Mini Flag from the tables and the shelves in the office, in the house to the heads of the people on the streets and everywhere else manifestations happen. The following fabric headgears: a baseball cap, or visor cap, or a do-rag or a headband, or an ear band or bandanna can get it fixed on easily. Once the mini flag clip is fixed on the headgear, a mini stick flag or mini stick banner can be easily inserted into it, and hold straight. The bearer can then go hands free to show off pride or support with a flag or a banner floating on his head.

DETAILED DESCRIPTION OF THE INVENTION

The Mini Flag Clip is a manufactured utility in solid material. The best material would be hard and rigid plastic or hard and rigid metal. The device is a flat squared plaque measuring ideally 5 cm by 4 cm. The edge is 2 mm thick. These measurements are critical to ensure a light weight and suitability to a fabric headgear on the head of a person and can be a little less or more and the device will still function.

Figure 1:
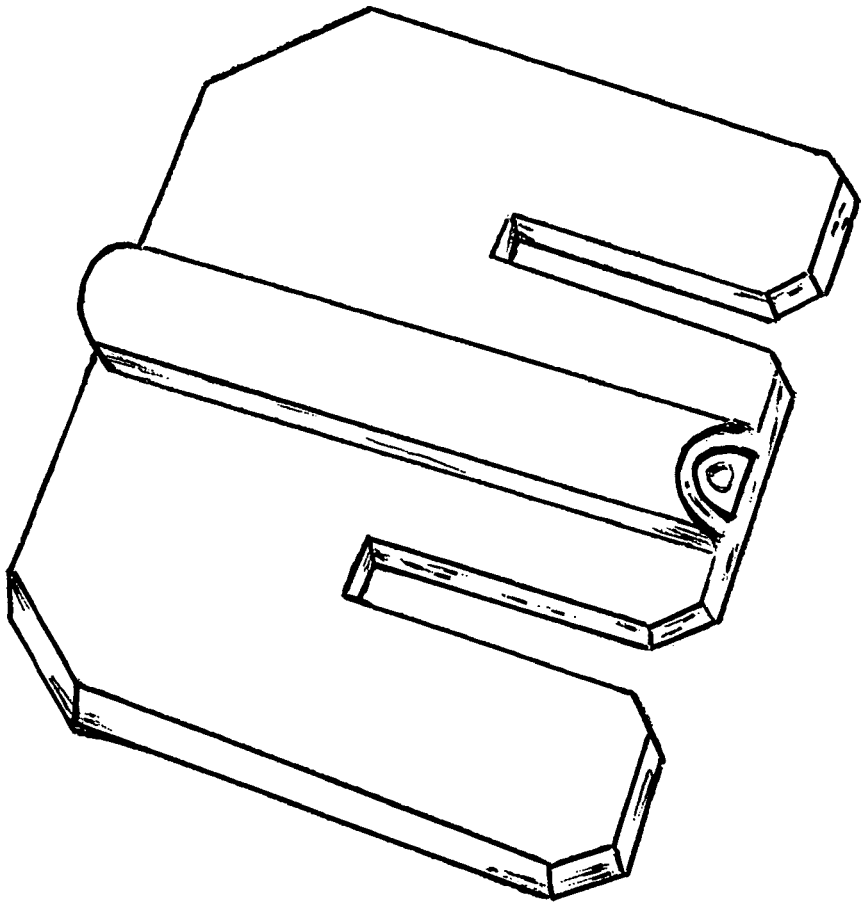
FIG. 1: The Mini Flag Clip in perspective view lying flat, face up, seen from above on one corner.
Figure 2:
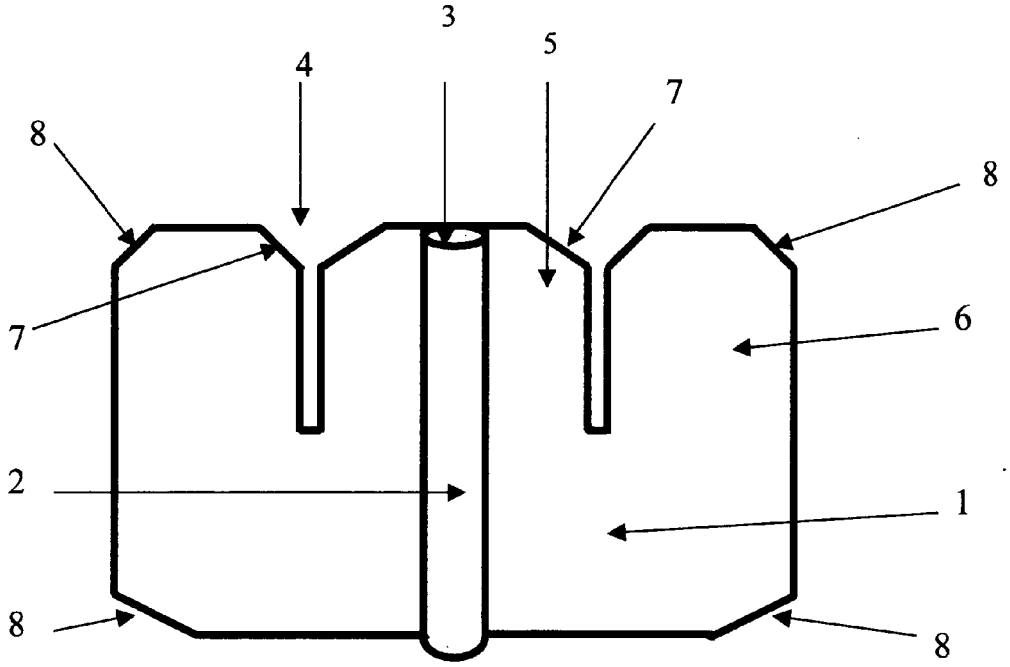
FIG. 2: The Mini Flag Clip in standing position seen from front.

A tube 2 merges on one surface of the plaque 1 right in the middle, shown in annotations of FIG. 2. The tube is parallel to the width edges of the square plaque and closed at one end. That end is the base. The hole 3 in the tube is circular with 5 mm of diameter and is 3.8 cm deep.

Two incisions 4, parallel and symmetric to the tube, cut the plaque starting from the length side where the tube is open, shown in FIG. 2. The symmetric incisions are ½ cm away from the tube and 1.3 cm away from the width edges of the plaque. The incisions are identical in size: 3 mm in width and 2.5 cm in length.

The two incisions sculpt the plaque in the shape of three vertical protrusions standing on a horizontal base: a major center protrusion 5 where the tube merges, and two minor lateral protrusions 6 at each side, shown in FIG. 2. The major protrusion is 1.8 cm large, the two minor protrusions are identical and measure 1.3 cm each in width.

Figure 3:
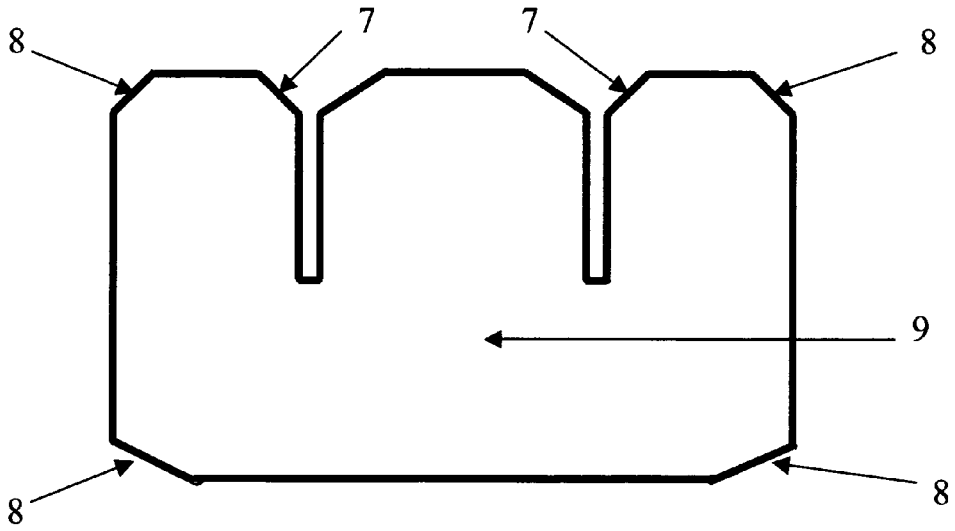
FIG. 3: The Mini Flag Clip in standing position seen from back.

The entrance 7 to the incisions is cut slanting in a manner to ease the engagement of the clip to the bottom thin circular edge of a fabric headgear. All the four corners 8 of the plaque are also slightly cut slant to avoid a sharp contact with the body of the bearer, shown in FIG. 2. The backside 9 of the Mini Flag Clip is totally flat as seen in FIG. 3, to assure a smooth contact with the head of the bearer.

Figure 4:
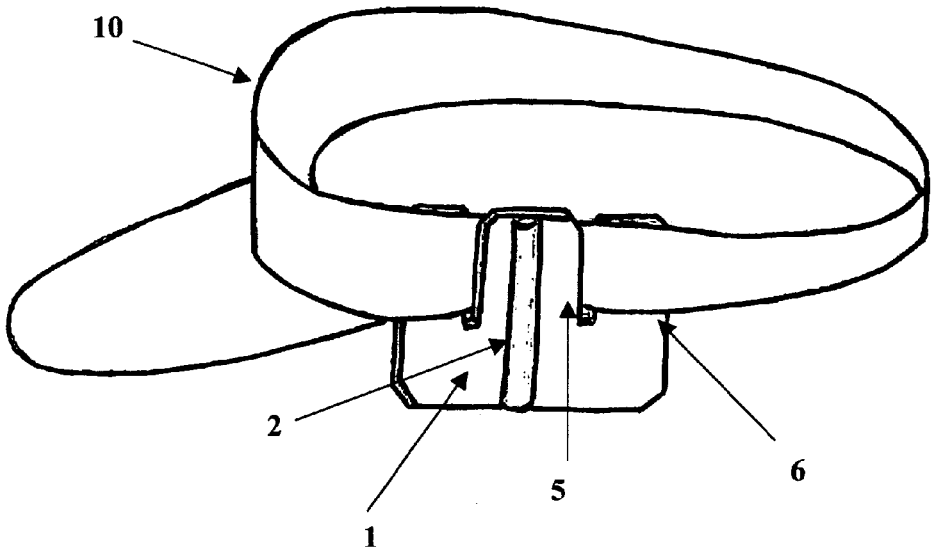
FIG. 4: The Mini Flag Clip attached to a common visor cap.
Figure 7:
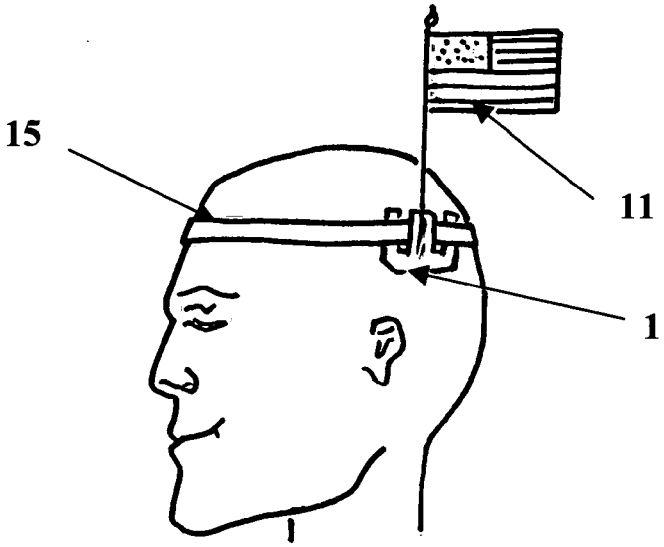
FIG. 7: Mini Flag Clip attached to a headband on a head with a mini stick flag inserted.
Figure 8:
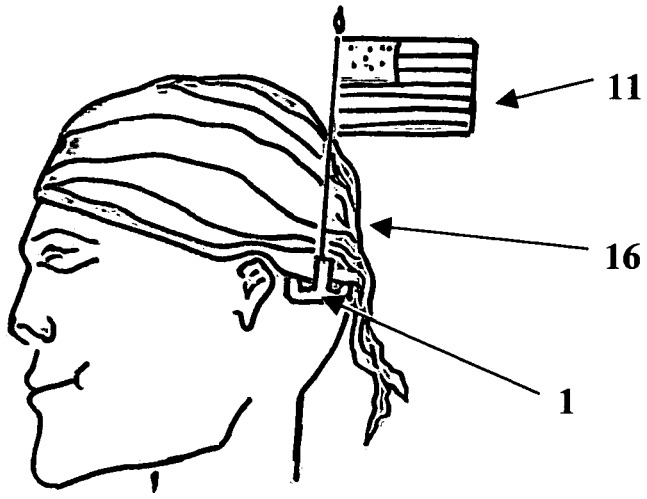
FIG. 8: Mini Flag Clip attached to a do-rag on a head with mini stick flag inserted.
Figure 9:
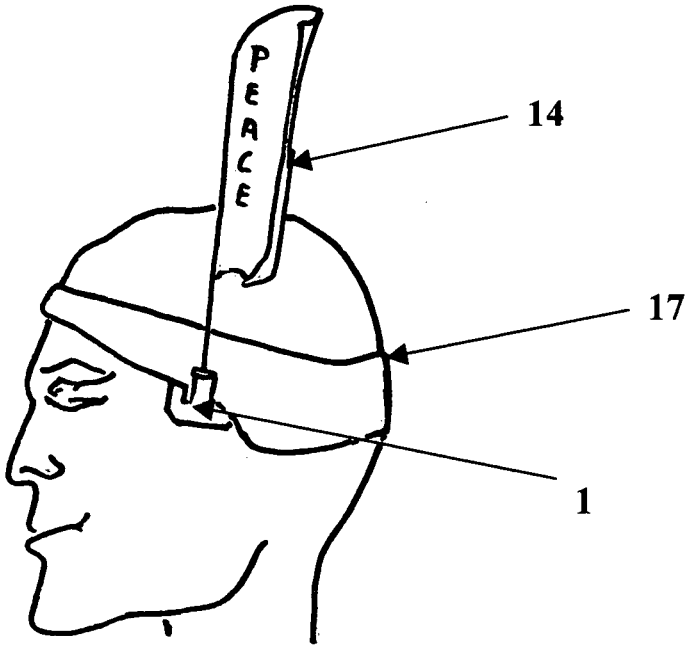
FIG. 9: Mini Flag Clip attached to an ear band on a head with a mini stick banner inserted.

As specified in size, measurements and material, the Mini Flag Clip is a ready to plug and use device. To use it, one just needs a regular fabric headgear like a baseball cap, or a visor cap, or a military hat, or a bandana, or a do-rag or an ear band and a mini stick flag. Before wearing the fabric headgear one just proceeds to pass any point at the bottom circular thin edge of the garment through the protrusions of the Mini Flag Clip by the incisions. FIG. 4 illustrates the outcome of the procedure showing a common visor cap 10 with the Mini Flag Clip inserted on it. A do-rag 16 in FIG. 8, a bandanna 13 in FIG. 6, a headband 15 in FIG. 7, an earband 17 in FIG. 9 or baseball cap 12 in FIG. 5 will use the same procedure.

When inserting the clip on the headgear, the tube and the major protrusion are left outside of the garment and the minor protrusions go inside. The clip grips the garment and stays fixed. The mini flag's stick is then inserted in the tube and the mini flag 11 stands straight up, shown in FIG. 5.

Figure 5:
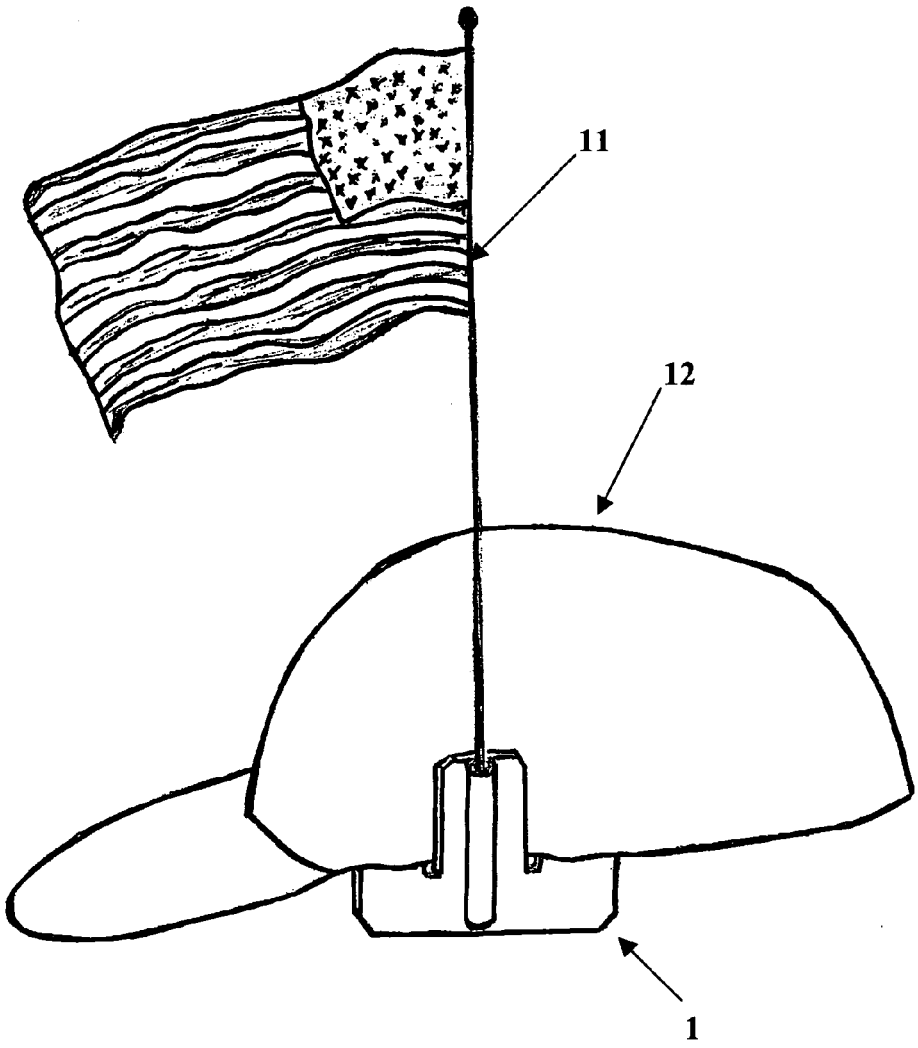
FIG. 5: The Mini Flag Clip attached to a baseball cap and a mini stick flag inserted into the Mini Flag Clip.
Figure 6:
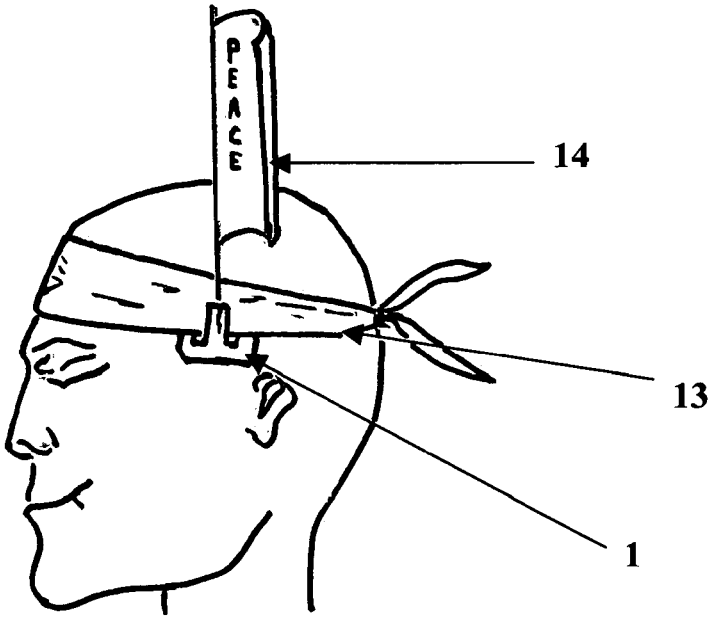
FIG. 6: Mini Flag Clip attached to a bandanna on a head with a mini stick banner inserted.

As seen in FIG. 4 and FIG. 5, the protrusions on the device are intended to apply a strong enough hold on the bottom circular tin edge of any ordinary fabric headgear; and the tube is to host the standard of a mini stick flag 11 in FIG. 5 or a mini stick banner 14 in FIG. 6. The hole in the tube is just large enough to insert and remove easily a common mini stick flag or a mini stick banner.

The invention claimed is:

1. A flag clip for attaching to fabric headgear, comprising:

a plate having a front surface and a back surface, first and second lateral sides, first and second longitudinal sides, and four chamfered outer corners;

the rectangular plate further having a pair of incisions extending from the first lateral side toward the second lateral side, the incisions defining first and second lateral protrusions and a central protrusion therebetween, the incisions each having an entrance and an opposite closed end;

wherein the entrances of the incisions are chamfered to facilitate engagement with the fabric headgear;

a tube having a semicylindrical shape defined by a flat outer surface and a rounded outer surface, the flat outer surface of the tube mounted directly on the front surface of the rectangular plate, the tube positioned on the central protrusion and extending in a direction parallel to the longitudinal sides; and wherein the flag clip is capable of being attached to the headgear worn by a user by positioning the central protrusion at the exterior side of the headgear and the two lateral protrusions at the inside of the headgear, such that the back surface of the plate is in contact with the head of the user.

2. The flag clip of claim 1, wherein the tube has a closed end and an opened end, the closed end allowing for the tube to support a stick of a miniature flag or banner.

3. The flag clip of claim 1, wherein the closed ends of the incisions are positioned halfway between the first lateral side and the second lateral side of the plate.

4. The flag clip of claim 1, wherein the incisions each have a depth of 2.5 cm and a width of 3 mm, in order to accommodate a thin edge of the fabric headgear.

* * * * *